US006349434B1

(12) United States Patent
Zhuang

(10) Patent No.: US 6,349,434 B1
(45) Date of Patent: Feb. 26, 2002

(54) FOLDING FRAME DEVICE FOR PLAYPEN

(76) Inventor: Yu-Lin Zhuang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/546,152

(22) Filed: Apr. 5, 2000

(51) Int. Cl.[7] ..... A47D 7/00
(52) U.S. Cl. ..... 5/99.1; 5/98.1
(58) Field of Search ..... 5/99.1, 98.1, 93.1

(56) References Cited

U.S. PATENT DOCUMENTS 5,239,714 A * 8/1993 Huang ..... 5/99.1
5,358,220 A * 10/1994 Yu-Kuang ..... 5/99.1
5,819,342 A * 10/1998 Williams ..... 5/99.1
5,911,653 A * 6/1999 Cheng ..... 5/99.1
6,125,483 A * 10/2000 Stroud et al. ..... 5/98.1

* cited by examiner

*Primary Examiner*—Alexander Grosz

(57) ABSTRACT

A folding frame device for a playpen includes four leg posts, four bottom rods each pivotally mounted on a respective leg post and each pivotally mounted on a support base which is located at a central position of the bottom rods, four upright rods each secured to a respective leg post, four fixed bases each secured to a respective upright rod, four pairs of top rods each pivotally mounted between two adjacent fixed bases, four coupling bases each pivotally mounted on a respective pair of top rod, four first connecting bases each secured on a respective bottom rod, two pairs of long side rods each mounted between two adjacent first connecting bases, four second connecting bases each secured on a respective bottom rod, two pairs of short side rods each mounted between two adjacent second connecting bases, and four support brackets, wherein two of the four support brackets each pivotally mounted on a mediate portion of a respective pair of long side rods, and the other two support brackets each pivotally mounted on a mediate portion of a respective pair of short side rods.

15 Claims, 13 Drawing Sheets

FOLDING FRAME DEVICE FOR PLAYPEN

FIELD OF THE INVENTION

The present invention relates to a folding flame device, and more particularly to a folding frame device for a playpen.

DESCRIPTION OF THE RELATED ART

A conventional playpen comprises a frame including a plurality of connecting rods pivotally connected with each other. However, the pivot connection structure between the connecting rods of the frame is simple and rough, and the folding positioning action of the connecting rods is not stable and rigid enough so that the frame of the playpen easily becomes loose or evenly sways during long-term utilization, thereby limiting the versatility and utility of the playpen.

SUMMARY OF THE INVENTION

The present invention has arisen to mitigate and/or obviate the disadvantage of the conventional playpen.

In accordance with one aspect of the present invention, there is provided a folding frame device for a playpen comprising four leg posts respectively located at four corners of the playpen; four bottom rods each having a first end pivotally mounted on a respective one of the four leg posts; a support base located at a central position of the four bottom rods, and a second end of each of the four bottom rods being pivotally mounted on the support base; four upright rods each having a lower end secured to a respective one of the four leg posts; four fixed bases each secured to an upper end of a respective one of the four upright rods; four pairs of top rods each pivotally mounted between two adjacent fixed bases; four coupling bases each pivotally mounted on a mediate portion of a respective one pair of the four pairs of top rods; four first connecting bases each secured on a mediate portion of a respective one of the four bottom rods; two pairs of long side rods each pivotally mounted between two adjacent first connecting bases; four second connecting bases each secured on the mediate portion of a respective one of the four bottom rods; two pairs of short side rods each pivotally mounted between two adjacent second connecting bases; and four support brackets, two of the four support brackets each pivotally mounted on a mediate portion of a respective one pair of the two pairs of long side rods, and the other two support brackets each pivotally mounted on a mediate portion of a respective one pair of the two pairs of short side rods.

Further benefits and advantages of the present invention will become apparent after a careful reading of the detailed description with appropriate reference to the accompanying drawings.

DETAILED DESCRIPTION OF THE INVENTION

Figure 1:
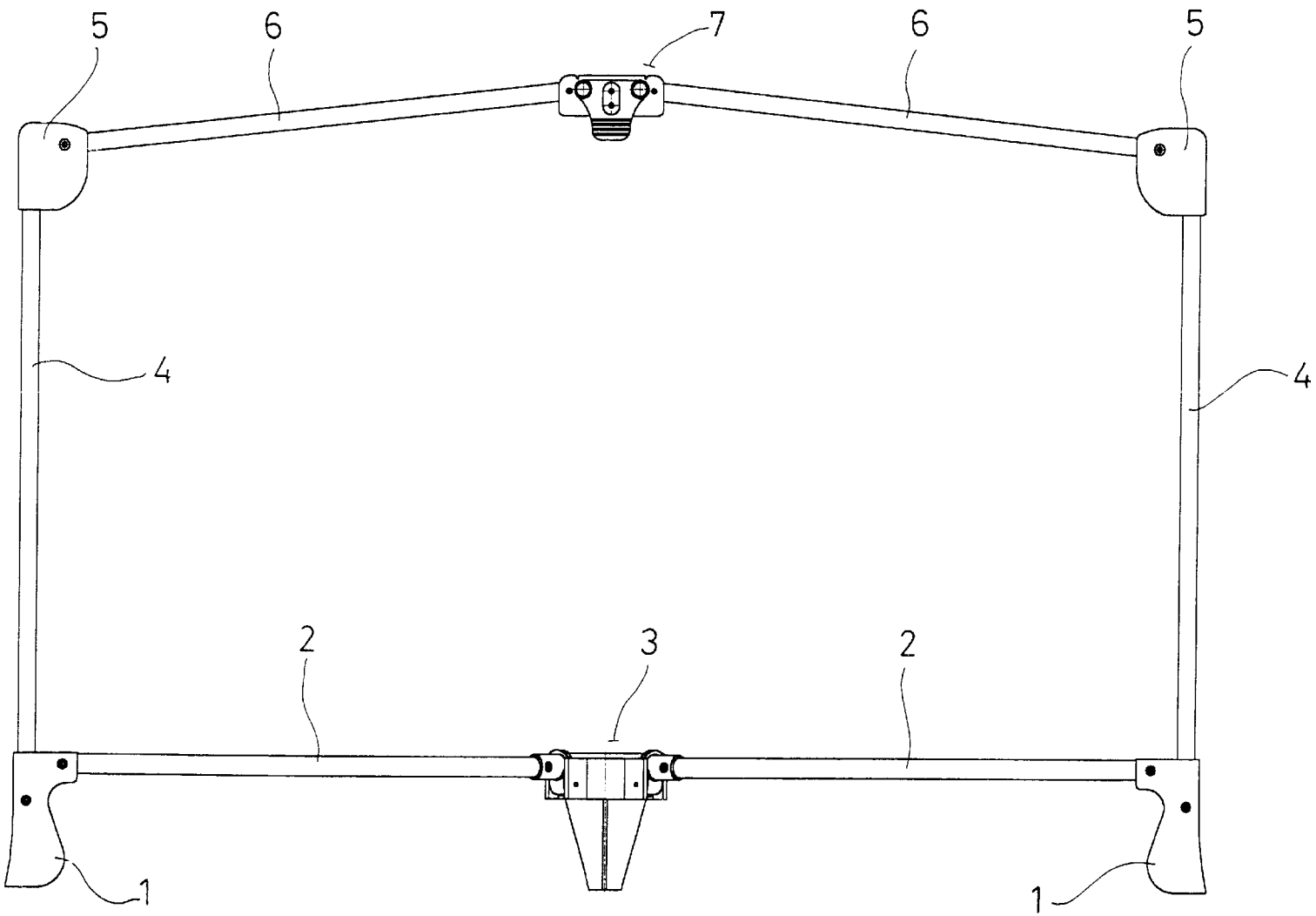
FIG. 1 is a front plan view of a folding frame device for a playpen in accordance with the present invention.
Figure 2:
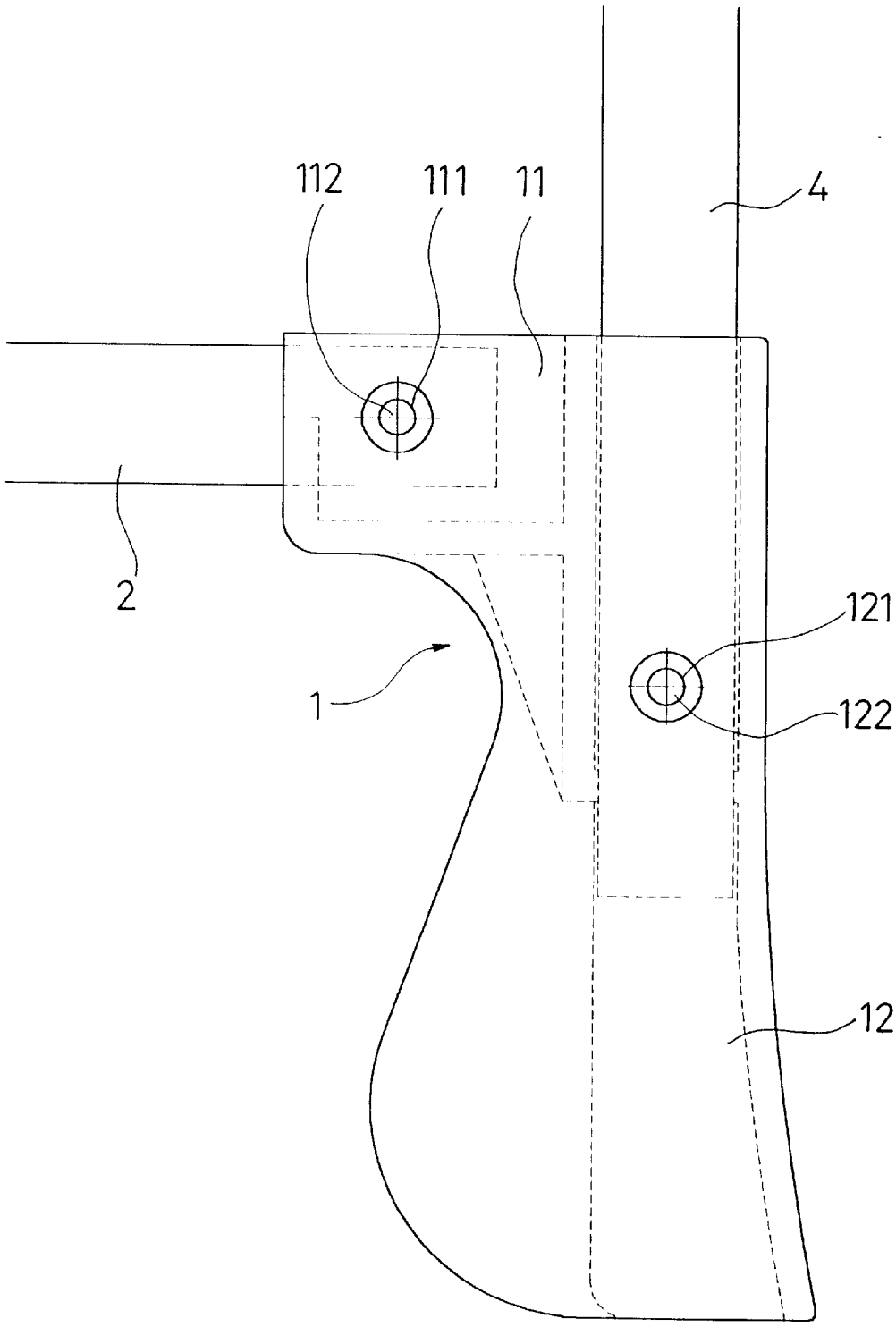
FIG. 2 is a partially cut-away enlarged view of the folding frame device as shown in FIG. 1.
Figure 3:
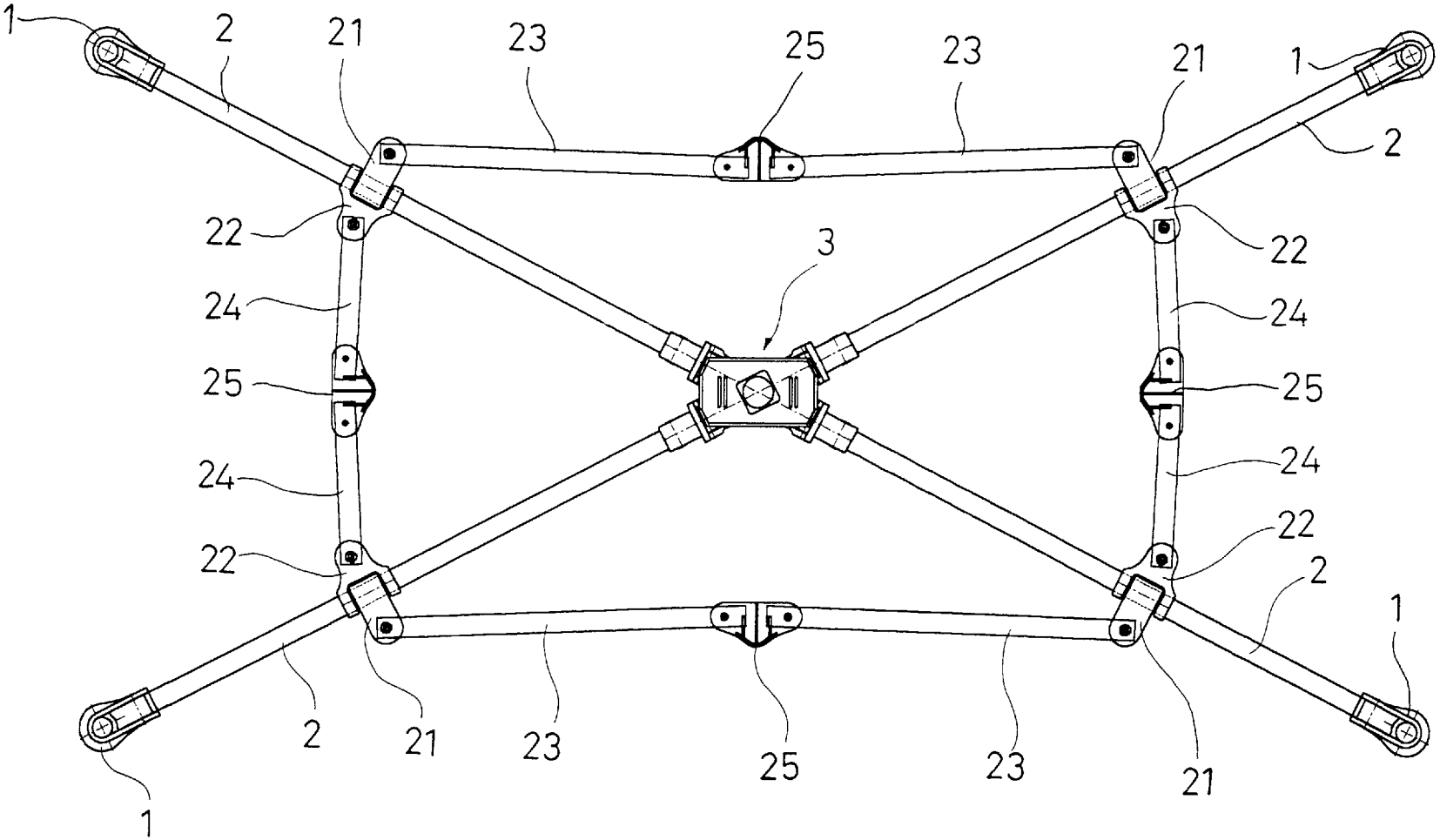
FIG. 3 is a top plan view of the folding frame device as shown in FIG. 1.

Referring to the drawings and initially to FIGS. 1–3, a folding frame device for a playpen in accordance with the present invention comprises four leg posts 1 respectively located at four corners of the playpen; four bottom rods 2 each having a first end pivotally mounted on a respective one of the four leg posts 1 and a second end pivotally mounted on a support base 3 which is located at a central position of the four bottom rods 2; four upright rods 4 each having a lower end secured to a respective one of the four leg posts 1; four fixed bases 5 each secured to an upper end of a respective one of the four upright rods 4; four pairs of top rods 6 each pivotally mounted between two adjacent fixed bases 5; four coupling bases 7 each pivotally mounted on a mediate portion of a respective one pair of the four pairs of top rods 6; four first connecting bases 21 each secured on a mediate portion of a respective one of the four bottom rods 2; two pairs of long side rods 23 each pivotally mounted between two adjacent first connecting bases 21; four second connecting bases 22 each secured on the mediate portion of a respective one of the four bottom rods 2; two pairs of short side rods 24 each pivotally mounted between two adjacent second connecting bases 22; and four support brackets 25, wherein two of the four support brackets 25 are each pivotally mounted on a mediate portion of a respective pair of long side rods 23, and the other two support brackets 25 are each pivotally mounted on a mediate portion of a respective pair of short side rods 24.

Referring to FIG. 2, each of the four leg posts 1 includes a receiving opening 11 defined therein for receiving the first end of the respective bottom rod 2, a pivot hole 111 defined through a wall of the receiving opening 11, and a pivot pin 112 extending through the pivot hole 111 and through the first end of the respective bottom rod 2 so that the first end of the bottom rod 2 is pivoted on the leg post 1.

Each of the four leg posts 1 also includes a passage 12 defined therein for receiving the lower end of the respective upright rod 4, a fixed hole 121 defined through a wall of the passage 12, and a positioning member 122 extending through the fixed hole 121 and through the lower end of the respective upright rod 4 so that the lower end of the upright rod 4 is fixed on the leg post 1.

Figure 4:
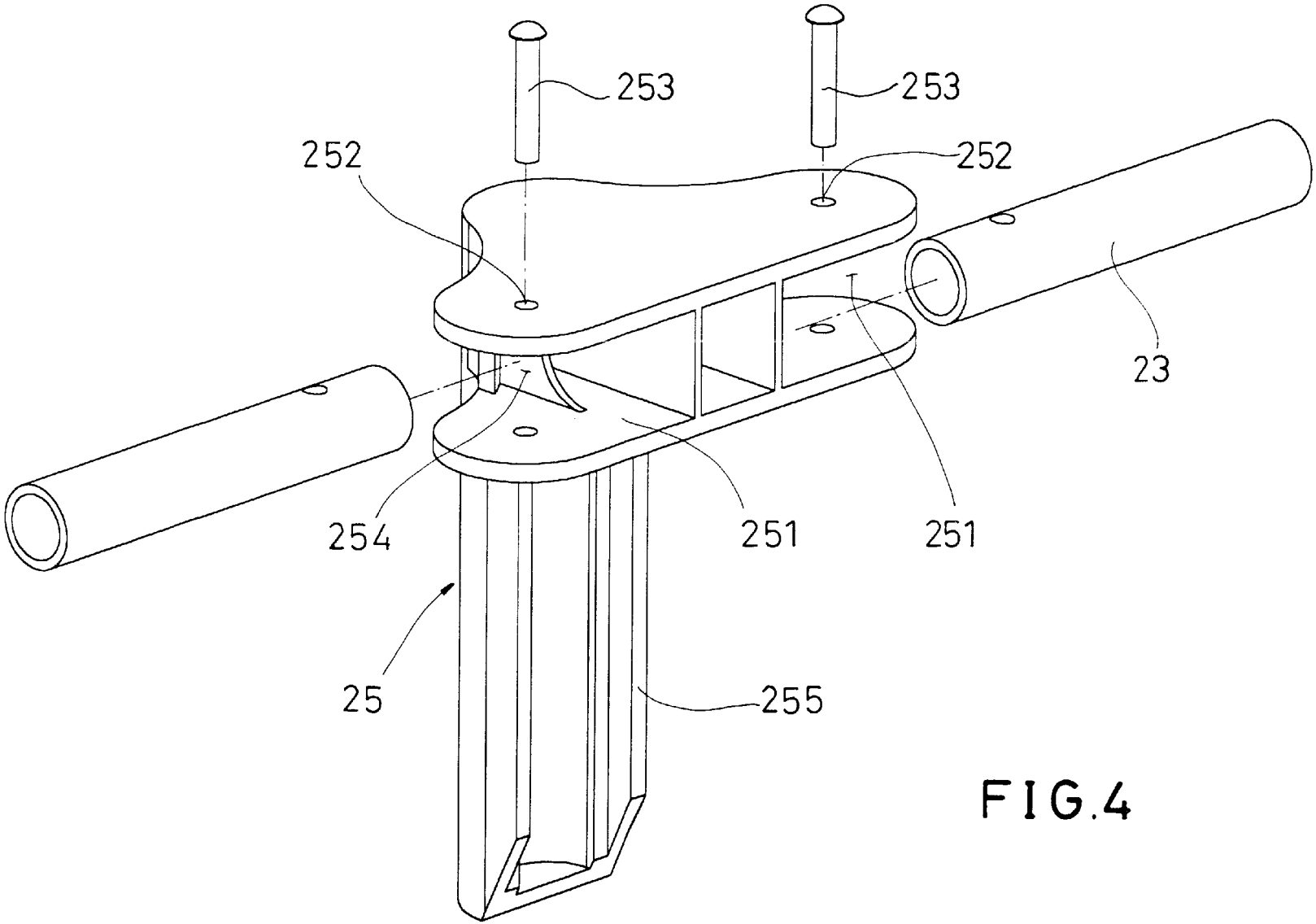
FIG. 4 is an exploded view of a support bracket of the folding frame device as shown in FIG. 1.

Referring to FIG. 4, each of the four support brackets 25 includes two ends each defining a receiving chamber 251 for receiving one end of the respective long side rod 23, an arcuate abutting plate 254 secured in the receiving chamber 251, a pivot hole 252 defined through a wall of the receiving chamber 251, two pivot pins 253 each extending through the pivot hole 252 and through the respective long side rod 23 so that the long side rod 23 is pivoted on the support bracket 25, and a support post 255 extending downward from the support bracket 25 to abut the ground.

Figure 5:
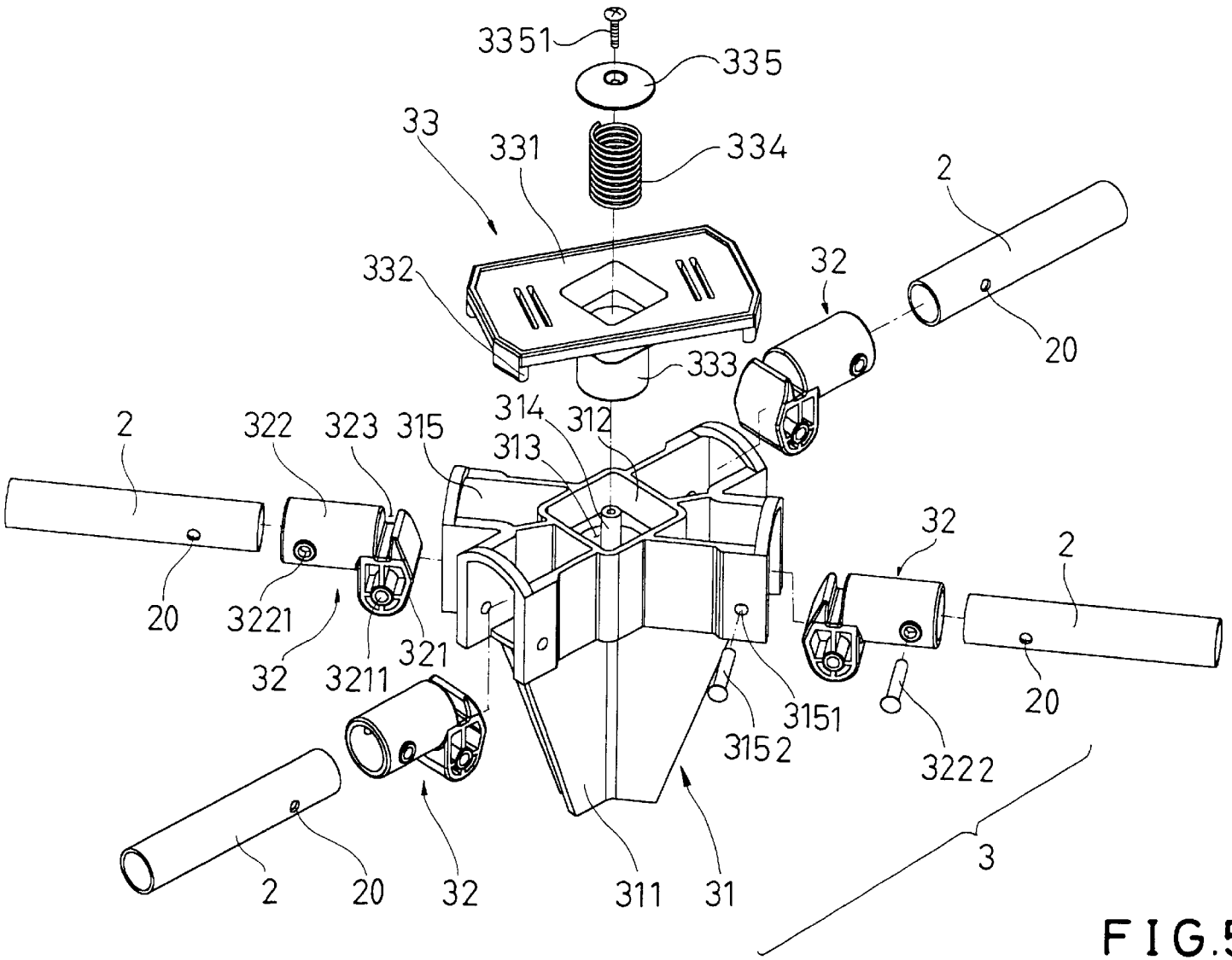
FIG. 5 is an exploded view of a support base of the folding frame device as shown in FIG. 1.
Figure 6:
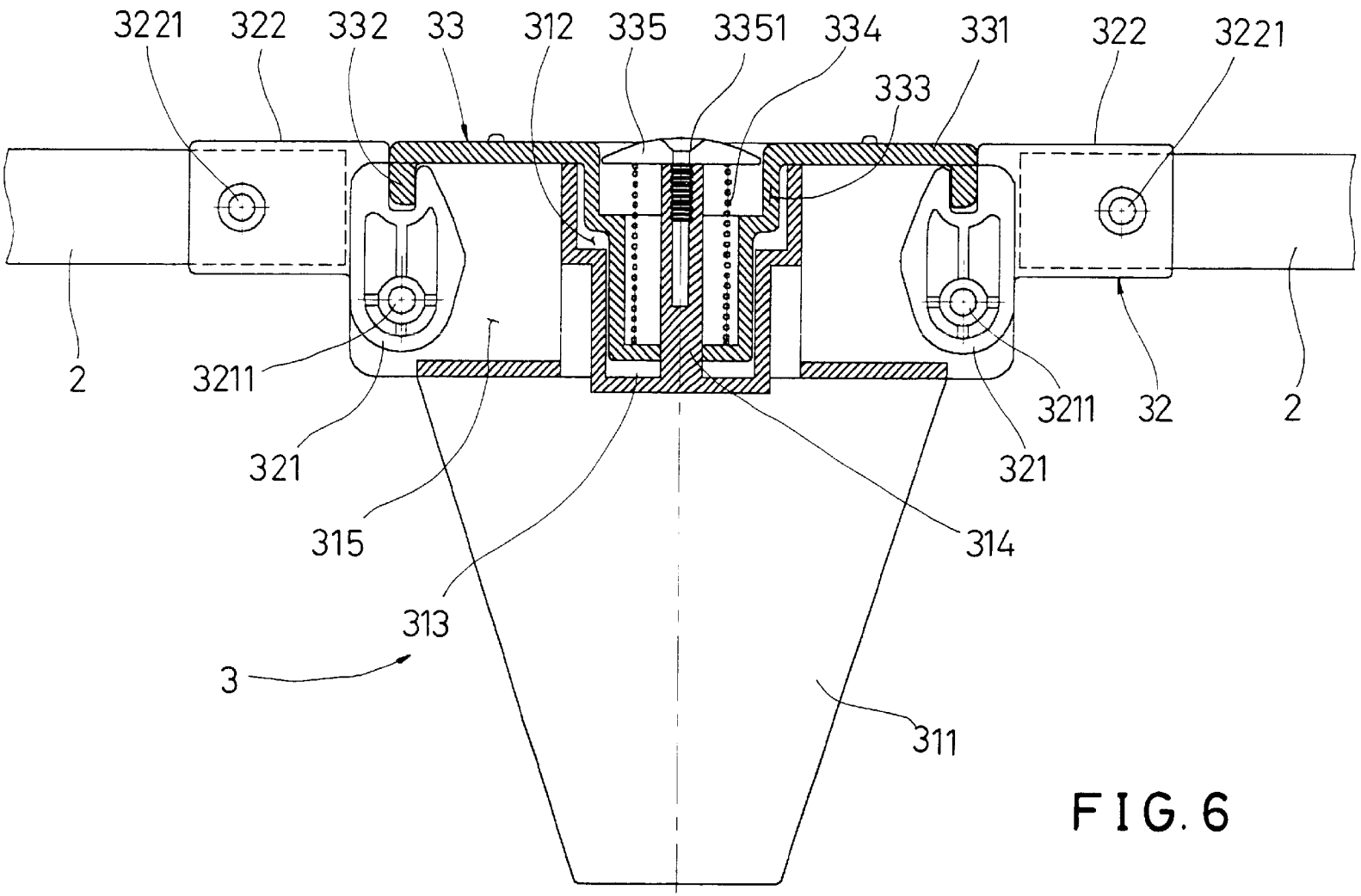
FIG. 6 is a front plan cross-sectional assembly view of the support base as shown in FIG. 5.

Referring to FIGS. 5 and 6 with reference to FIGS. 1 and 3, the support base 3 includes a body 31 including a rectangular hollow central base 312 having a lower portion defining a circular recess 313, four symmetrically arranged hollow chambers 315 each extending outward from the central base 312, and a support plate 311 extending downward from the hollow central base 312; four pivot bases 32 each mounted between the second end of a respective one of the four bottom rods 2 and a respective one of the four hollow chambers 315 and each including a sleeve 322 fitted on the second end of the respective bottom rod 2, a pivot section 321 pivotally mounted in the respective hollow chamber 315, and a retaining groove 323 defined in the pivot section 321; and a positioning base 33 detachably mounted on the body 31 and including a platform 331 movably mounted on the four hollow chambers 315 and having four corners each including an insert block 332 extending downward to move therewith and detachably received in the retaining groove 323 of a respective one of the four pivot bases 32, and a hollow coupling post 333 extending downward from the platform 331 to be secured in the central base 312 and having a cylindrical lower portion received in the circular recess 313.

The second end of each of the four bottom rods 2 defines a first through hole 20, each of the four pivot bases 32 includes a second through hole 3221 defined in the sleeve 322, and a positioning pin 3222 extending through the second through hole 3221 and the first through hole 20 for securing the sleeve on the bottom rod 2.

Each of the four pivot bases 32 includes a first pivot hole 3211 defined in the pivot section 321 thereof, each of the four hollow chambers 315 includes a second pivot hole 3151 defined therein, and a positioning pin 3152 extending through the second pivot hole 3151 and the first pivot hole 3211 so that the pivot section 321 is pivoted in the hollow chamber 315.

The body 31 includes a central threaded column 314 secured in the hollow chamber 312 and extending through the hollow coupling post 333, and the positioning base 33 includes a retaining cover 335 secured on a top end of the central threaded column 314, a locking screw 3351 extending through the retaining cover 335 and screwed into the central threaded column 312 for securing the retaining cover 335 on the central threaded column 314, and an elastic member 334 received in the coupling post 333 and biased between the retaining cover 335 and a bottom wall of the coupling post 333.

Figure 7:
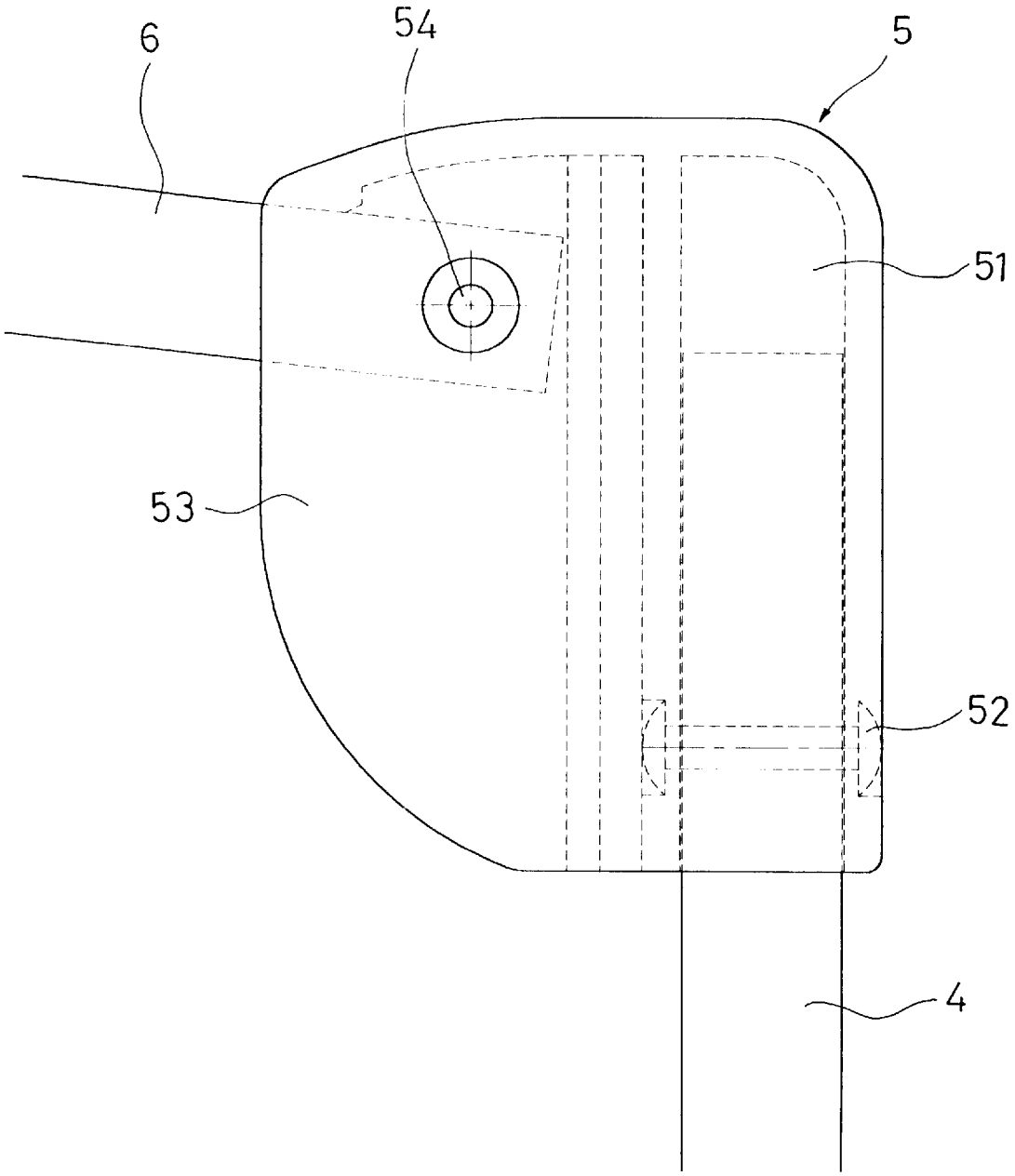
FIG. 7 is a partially cut-away enlarged view of the folding frame device as shown in FIG. 1.

Referring to FIG. 7, each of the four fixed bases 5 defines a vertical hole 51 for receiving an upper end of the respective upright rod 4, and includes a positioning pin 52 extending through a wall of the fixed base 5 and through the upright rod 4 for securing the fixed base 5 on the upright rod 4.

Each of the four fixed bases 5 defines a U-shaped receiving chamber for receiving the respective top rod 6, and includes a pivot pin 54 in turn extending through a wall of the fixed base 5 and through the top rod 6 so that the top rod 6 is pivoted on the fixed base 5.

Figure 8:
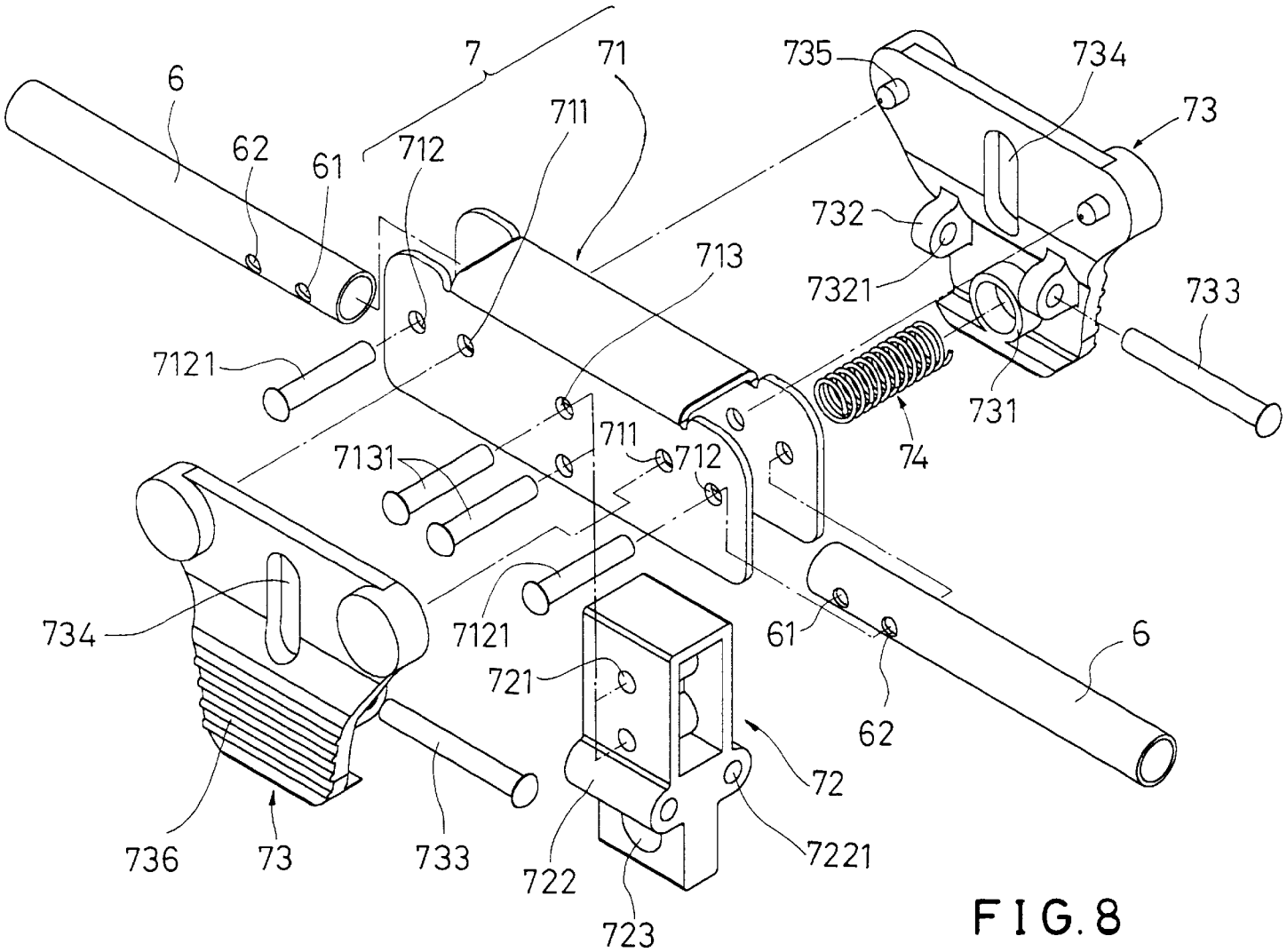
FIG. 8 is an exploded view of a coupling base of the folding frame device as shown in FIG. 1.
Figure 9:
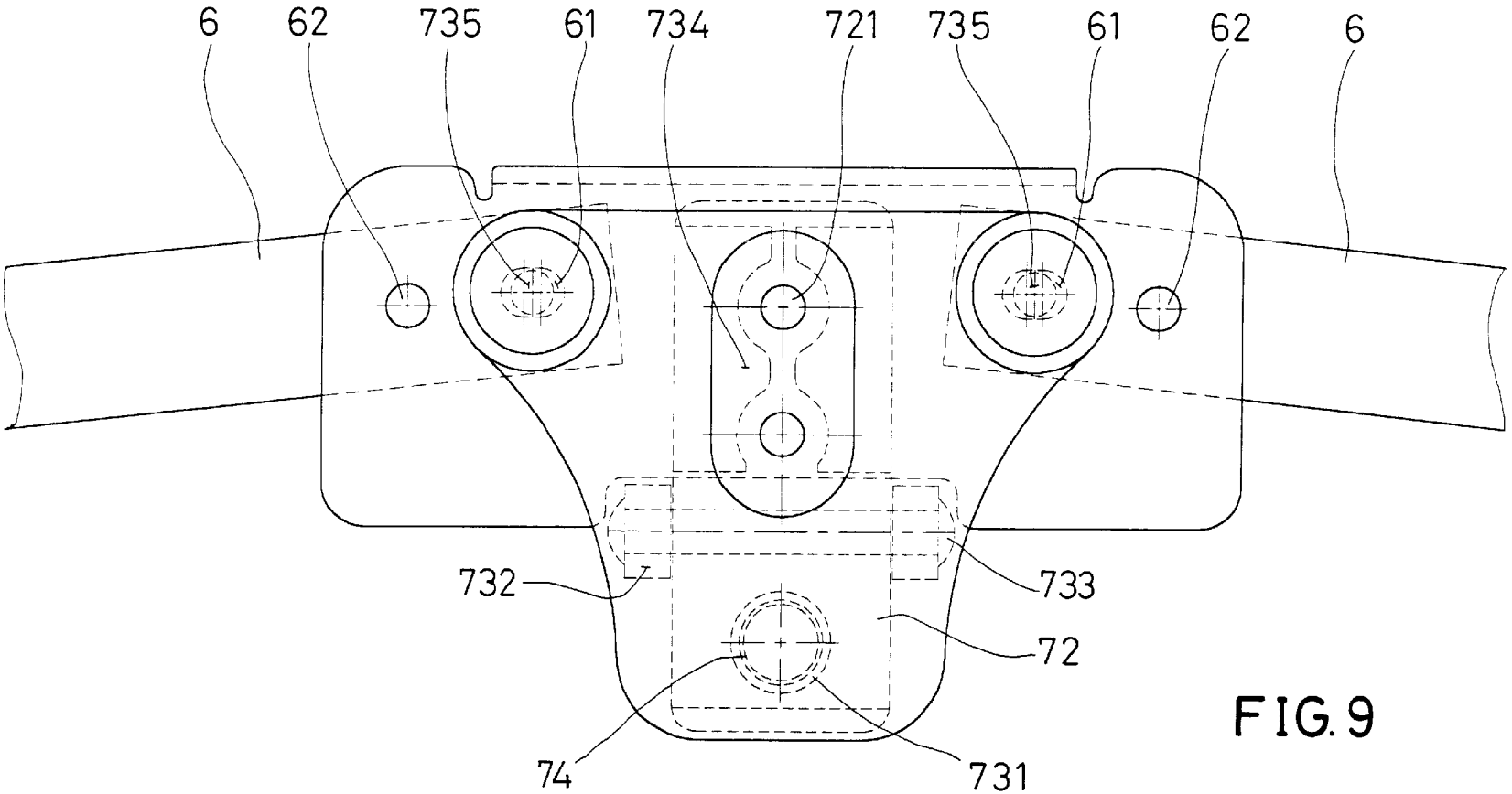
FIG. 9 is a front plan assembly view of the coupling base as shown in FIG. 8.
Figure 10:
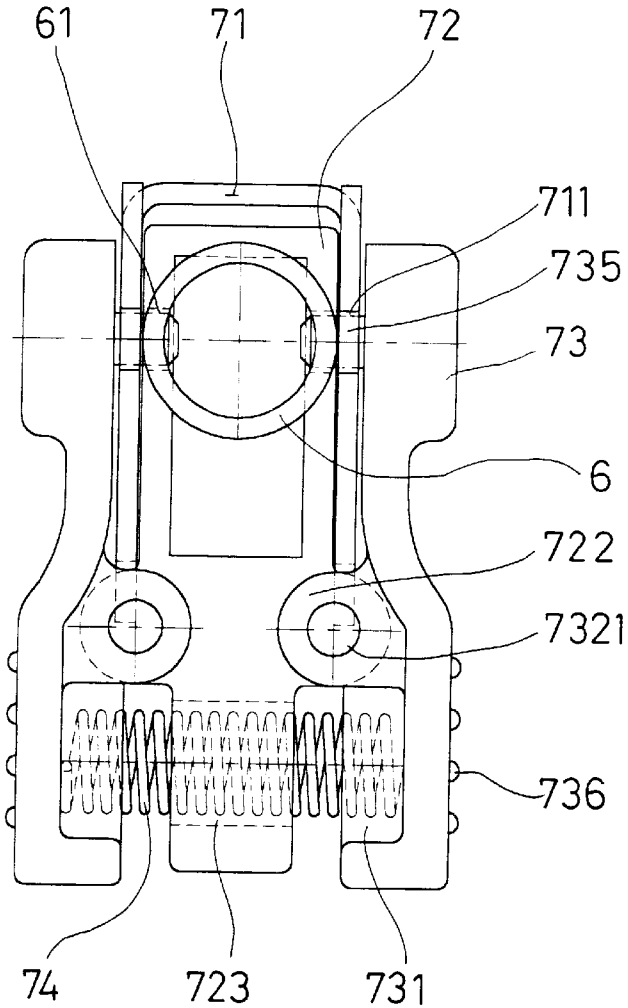
FIG. 10 is a side plan assembly view of the coupling base as shown in FIG. 8.

Referring to FIGS. 8–10 with reference to FIGS. 1 and 3, each of the top rods 6 has one distal end defining an oblong hole 61 and a circular hole 62. Each of the four coupling bases 7 includes a substantially inverted U-shaped connecting bracket 71 mounted on two adjacent top rods 6 and including two side walls each having two ends each defining an inner hole 711 and an outer hole 712, and a pivot shaft 7121 in turn extending through the outer hole 712 and the circular hole 62 so that the top rod 6 is pivoted on the connecting bracket 71; a fixing base 72 including an upper portion secured in the connecting bracket 71; two pressing plates 73 each mounted on a respective side wall of the connecting bracket 71 and each having an upper portion, a mediate portion, and a lower portion, the mediate portion pivotally mounted on the fixing base 72, and the upper portion including two positioning stubs 735 each extending through the inner hole 711 and detachably received in the oblong hole 61 so that the top rod 6 is detachably secured on the connecting bracket 71; and a compression member 74 mounted between the two pressing plates 73 and having two ends each abutting the lower portion of the respective pressing plate 73.

Each of the two side walls of the connecting bracket 71 defines two vertically arranged first circular holes 713, the upper portion of each of the two pressing plates 73 defines an elongated slot 734 aligning with the two first circular holes 713, the upper portion of the fixing base 72 defines two vertically arranged second circular holes 721, and the connecting bracket 71 includes two positioning pins 7131 each extending through the respective first circular hole 713 and the respective second circular hole 721 for securing the fixing base 72 in the connecting bracket 71.

The mediate portion of each of the two pressing plates 73 includes two spaced pivot ears 732 each defining a circular hole 7321, the fixing base 72 has two sides each including an elongated arcuate rib 722 mounted between the two pivot ears 732 and defining a pivot hole 7221, and each of the two pressing plates 73 includes a pivot shaft 733 extending through the circular hole 7321 and the pivot hole 7221 so that the pressing plate 73 is pivoted on the fixing base 72.

The fixing base 72 has a lower portion defining a receiving hole 723 for receiving the compression member 74, and the lower portion of each of the two pressing plates 73 defines a receiving chamber 731 for receiving the respective end of the compression member 74. Each of the two pressing plates 73 includes an anti-slip portion 736 formed on the lower portion thereof.

In operation, referring to FIGS. 10–15 with reference to FIGS. 1–9, each of the positioning stubs 735 of each of the two pressing plates 73 is initially received in the oblong hole 61 of the top rod 6 by means of a pressing force exerted by the compression member 74 on the lower portion of the pressing plate 73 so that each of the top rods 6 is secured to the connecting bracket 71 as shown in FIG. 10.

Figure 12:
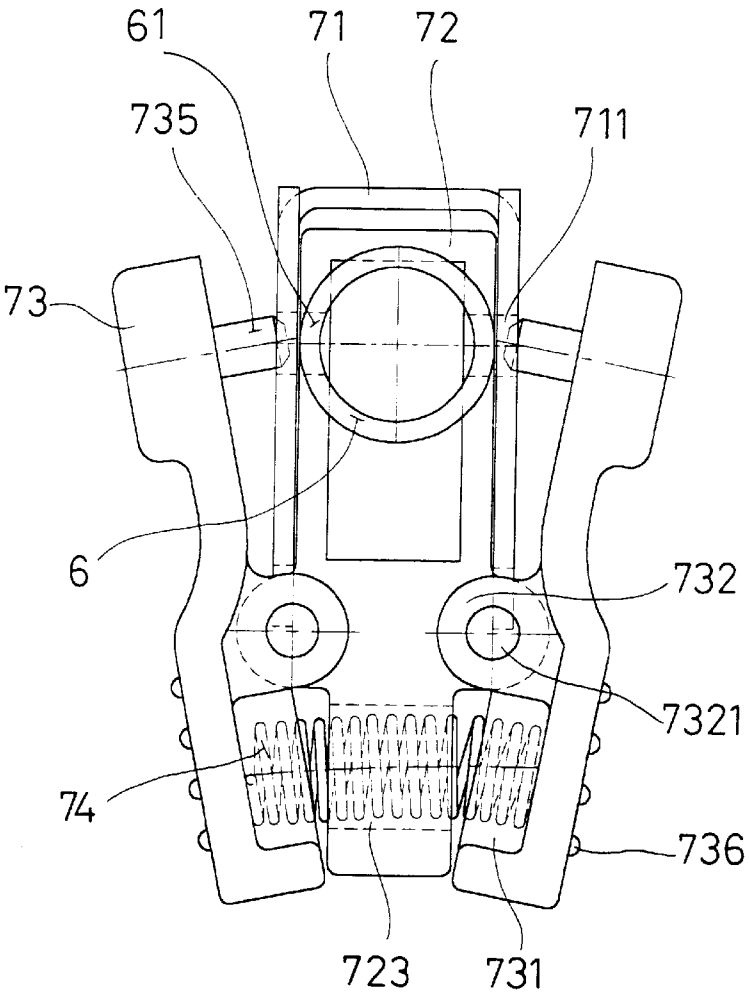
FIG. 12 is an operational view of the coupling base as shown in FIG. 10.
Figure 11:
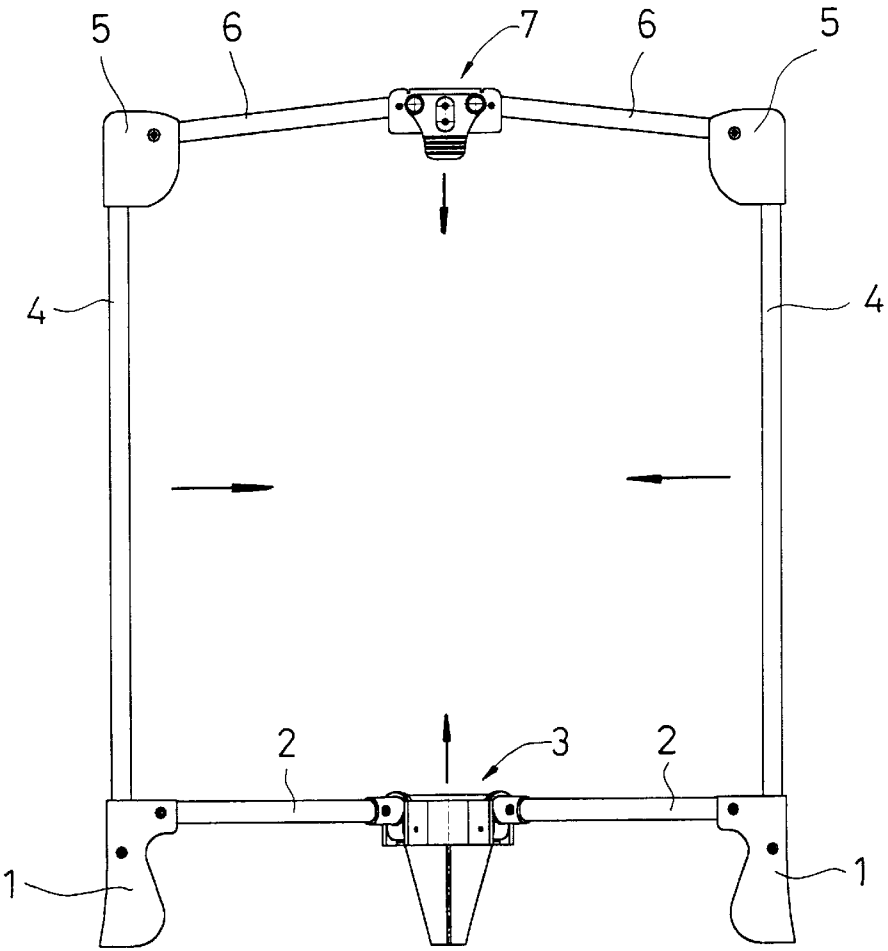
FIG. 11 is an operational view of the folding frame device as shown in FIG. 1.
Figure 13:
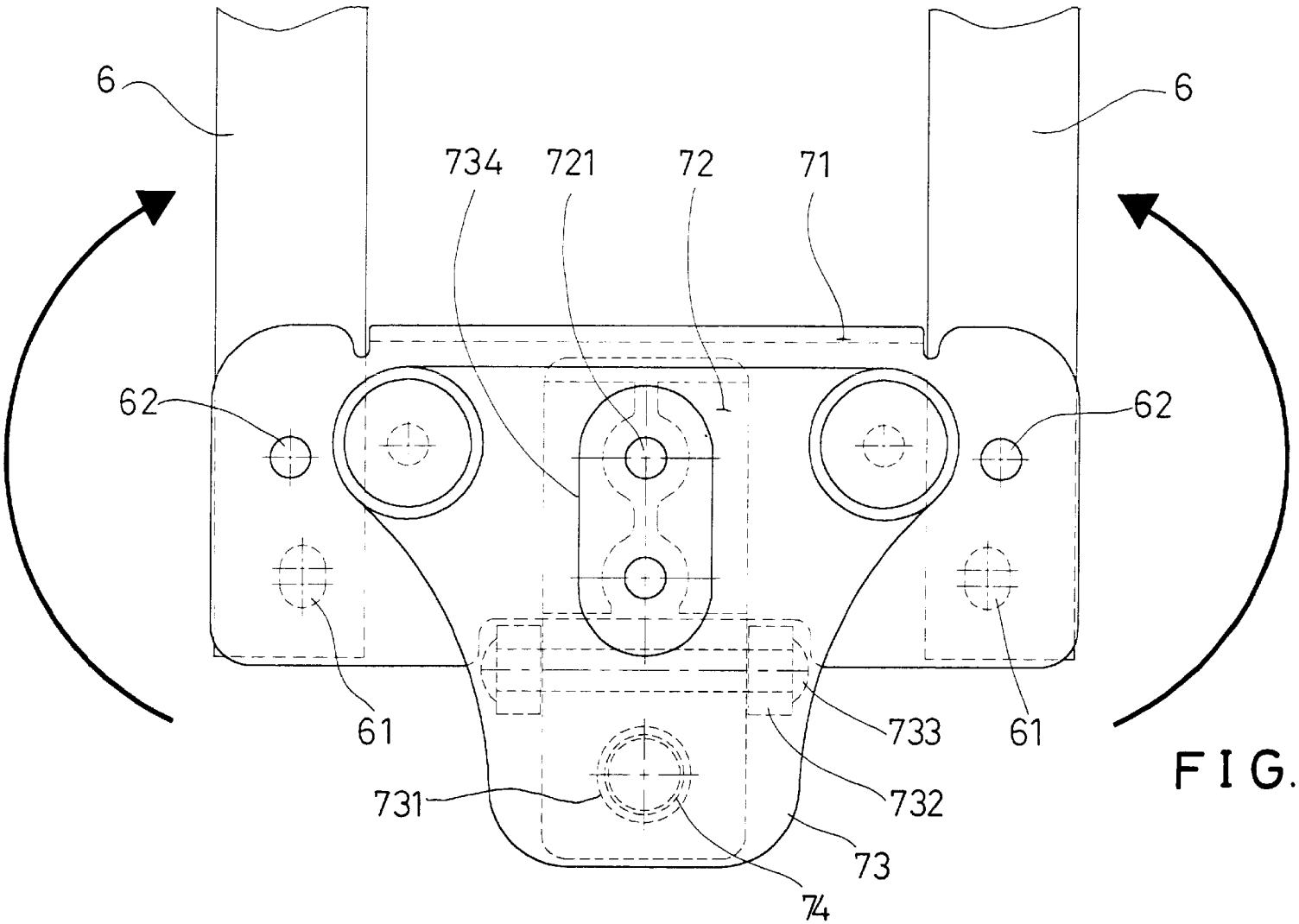
FIG. 13 is an operational view of the coupling base as shown in FIG. 9.

A user can exert a pressing force on the lower portion of each of the two pressing plates 73 so as to pivot the pressing plate 73 on the fixing base 72, thereby detaching each of the positioning stubs 735 of each of the two pressing plates 73 from the oblong hole 61 of the top rod 6 as shown in FIG. 12 so that each of the top rods 6 can be pivoted freely downward on the connecting bracket 7 to move from the position as shown in FIG. 11 to the position as shown in FIG. 13, thereby folding the top rods 6 together with the connecting brackets 7.

At the same time, the insert block 332 of the platform 331 of the positioning base 33 is initially received in the retaining groove 323 of the pivot section 321 of the pivot bases 32 so that each of the bottom rods 2 is secured to the respective hollow chamber 315 by the positioning base 33 as shown in FIG. 6.

Figure 15:
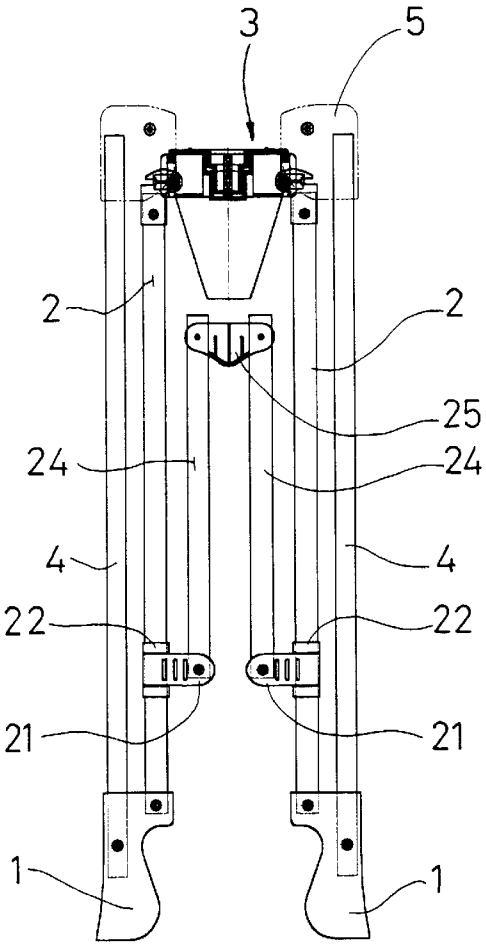
FIG. 15 is an operational view of the folding frame device as shown in FIG. 11.
Figure 14:
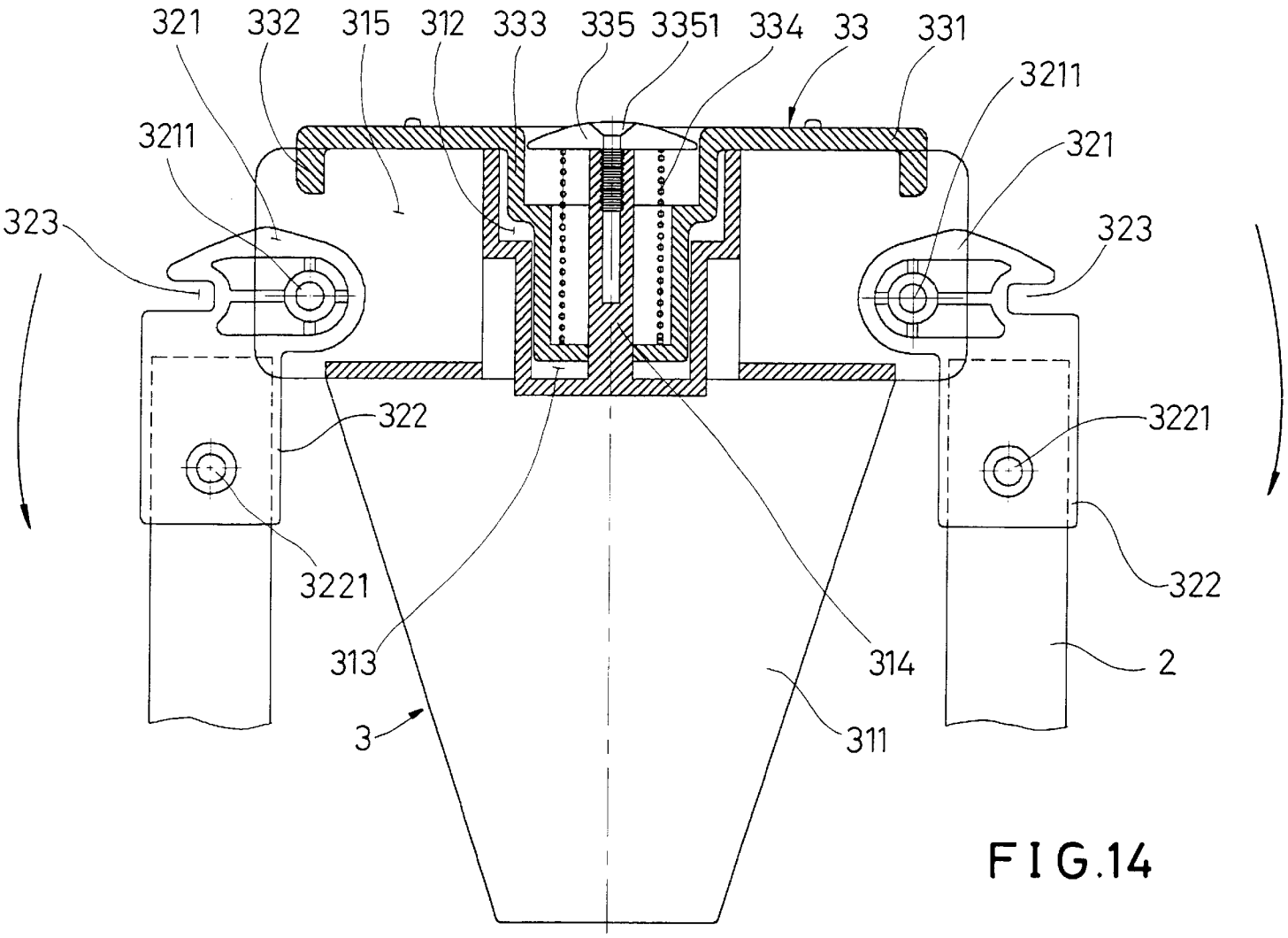
FIG. 14 is an operational view of the support base as shown in FIG. 6.

The user can then lift the platform 331 of the positioning base 33 to move the insert block 332 upward, thereby detaching the insert block 332 from the retaining groove 323 so that each of the bottom rods 2 can be pivoted freely upward on the respective hollow chamber 315 as shown in FIG. 14 to move from the position as shown in FIG. 11 to the position as shown in FIG. 15, thereby folding the bottom rods 2, the support base 3, and the upright rods 4 so as to fold the entire frame of the playpen.

It should be clear to those skilled in the art that further embodiments may be made without departing from the scope of the present invention.

What is claimed is:

1. A folding frame device for a playpen comprising:

four leg posts (1) respectively located at four corners of said playpen;

four bottom rods (2) each having a first end pivotally mounted on a respective one of said four leg posts (1);

a support base (3) located at a central position of said four bottom rods (2), and a second end of each of said four bottom rods (2) being pivotally mounted on said support base (3);

four upright rods (4) each having a lower end secured to a respective one of said four leg posts (1);

four fixed bases (5) each secured to an upper end of a respective one of said four upright rods (4);

four pairs of top rods (6) each pivotally mounted between two adjacent fixed bases (5);

four coupling bases (7) each pivotally mounted on a mediate portion of a respective one pair of said four pairs of top rods (6);

four first connecting bases (21) each secured on a mediate portion of a respective one of said four bottom rods (2);

two pairs of long side rods (23) each pivotally mounted between two adjacent first connecting bases (21);

four second connecting bases (22) each secured on the mediate portion of a respective one of said four bottom rods (2);

two pairs of short side rods 24 each pivotally mounted between two adjacent second connecting bases (22); and four support brackets (25), two of said four support brackets (25) each pivotally mounted on a mediate portion of a respective one pair of said two pairs of long side rods (23), and the other two support brackets (25) each pivotally mounted on a mediate portion of a respective one pair of said two pairs of short side rods (24).

2. The folding frame device in accordance with claim 1, wherein each of said four leg posts (1) includes a receiving opening (11) defined therein for receiving said first end of said respective bottom rod (2), a pivot hole (111) defined through a wall of said receiving opening (11), and a pivot pin (112) extending through said pivot hole (111) and through said first end of said respective bottom rod (2) so that said first end of said bottom rod (2) is pivoted on said leg post (1).

3. The folding frame device in accordance with claim 1, wherein each of said four leg posts (1) includes a passage (12) defined therein for receiving said lower end of said respective upright rod (4), a fixed hole (121) defined through a wall of said passage (12), and a positioning member (122) extending through said fixed hole (121) and through said lower end of said respective upright rod (4) so that said lower end of said upright rod (4) is fixed on said leg post (1).

4. The folding frame device in accordance with claim 1, wherein each of said four support brackets (25) includes two ends each defining a receiving chamber (251) for receiving one end of said respective long side rod (23), an arcuate abutting plate (254) secured in said receiving chamber (251), a pivot hole (252) defined through a wall of said receiving chamber (251), two pivot points (253) each extending through said pivot hole (252) and through said respective long side rod (23) so that said long side rod (23) is pivoted on said support bracket (25), and a support post (255) extending downward from said support bracket (25).

5. The folding frame device in accordance with claim 1, wherein said support base (3) includes:

a body (31) including a rectangular hollow central base (312) having a lower portion defining a circular recess (313), four symmetrically arranged hollow chambers (315) each extending outward from said central base (312), and a support plate (311) extending downward from said hollow central base (312);

four pivot bases (32) each mounted between said second end of a respective one of said four bottom rods (2) and a respective one of said four hollow chambers (315) and each including a sleeve (322) fitted on said second end of said respective bottom rod (2), a pivot section (321) pivotally mounted in said respective hollow chamber (315), and a retaining groove (323) defined in said pivot section (321); and a positioning base (33) detachably mounted on said body (31) and including a platform (331) movably mounted on said four hollow chambers (315) and having four corners each including an insert block (332) extending downward to move therewith and detachably received in said retaining groove (323) of a respective one of said four pivot bases (32), and a hollow coupling post (333) extending downward from said platform (331) to be secured in said central base (312) and having a cylindrical lower portion received in said circular recess (313).

6. The folding frame device in accordance with claim 5, wherein said second end of each of said four bottom rods (2) defines a first through hole (20), each of said four pivot bases (32) includes a second through hole (3221) defined in said sleeve (322), and a positioning pin (3222) extending through said second through hole (3221) and said first through hole (20) for securing said sleeve on said bottom rod (2).

7. The folding frame device in accordance with claim 5, wherein each of said four pivot bases (32) includes a first pivot hole (3211) defined in said pivot section (321) thereof, each of said four hollow chambers (315) includes a second pivot hole (3151) defined therein, and a positioning pin (3152) extending through said second pivot hole (3151) and said first pivot hole (3211) so that said pivot section (321) is pivoted in said hollow chambers (315).

8. The folding frame device in accordance with claim 5, wherein said body (31) includes a central threaded column (314) secured in said hollow chamber (312) and extending through said hollow coupling post (333), and said positioning base (33) includes a retaining cover (335) secured on a top end of said central threaded column (314), a locking screw (3351) extending through said retaining cover (335) and screwed into said central threaded column (312) for securing said retaining cover (335) on said central threaded column (314), and an elastic member (334) received in said coupling post (333) and biased between said retaining cover (335) and a bottom wall of said coupling post (333).

9. The folding frame device in accordance with claim 1, wherein each of said four fixed bases (5) defines a vertical hole (51) for receiving an upper end of said respective upright rod (4), and includes a positioning pin (52) extending through a wall of said fixed base (5) and through said upright rod (4) or securing said fixed base (5) on said upright rod (4).

10. The folding frame device in accordance with claim 1, wherein each of said four fixed bases (5) defines a U-shaped receiving chamber (54) for receiving said respective top rod (6), and includes a pivot pin (54) in turn extending through a wall of said fixed base (5) and through said top rod (6) so that said top rod (6) is pivoted on said fixed base (5).

11. The folding frame device in accordance with claim 1, wherein each of said top rods (6) has one distal end defining an oblong hole (61) and a circular hole (62), and each of said four coupling bases (7) includes:

a substantially inverted U-shaped connecting bracket (71) mounted on two adjacent top rods (6) and including two side walls each having two ends each defining an inner hole (711) and an outer hole (712), and a pivot shaft (7121) in turn extending through said outer hole (712) and said circular hole (62) so that said top rod (6) is pivoted on said connecting bracket (71);

a fixing base (72) including an upper portion secured in said connecting, bracket (71);

two pressing plates (73) each mounted on a respective side wall of said connecting bracket (71) and each having an upper portion, a mediate portion, and a lower portion, said mediate portion pivotally mounted on said fixing base (72), and said upper portion including two positioning stubs (735) each extending through said inner hole (711) and detachably received in said oblong hole (61) so that said top rod (6) is detachably secured on said connecting bracket (71); and a compression member (74) mounted between said two pressing plates (73) and having two ends each abutting said lower portion of said respective pressing plate (73).

12. The folding frame device in accordance with claim 11, wherein each of said two side walls of said connecting bracket (71) defines two vertically arranged first circular holes (713), said upper portion of each of said two pressing plates (73) defines an elongated slot (734) aligning with said two first circular holes (713), said upper portion of said fixing base (72) defines two vertically arranged second circular holes (721), and said connecting bracket (71) includes two positioning pins (7131) each extending through said respective first circular hole (713) and said respective second circular hole (721) for securing said fixing base (72) in said connecting bracket (71).

13. The folding frame device in accordance with claim 11, wherein said mediate portion of each of said two pressing plates (73) includes two spaced pivot ears (732) each defining a circular hole (7321), said fixing base (72) has two sides each including an elongated arcuate rib (722) mounted between said two pivot ears (732) and defining a pivot hole (7221), and each of said two pressing plates (73) includes a pivot shaft (733) extending through said circular hole (7321) and said pivot hole (7221) so that said pressing plate (73) is pivoted on said fixing base (72).

14. The folding frame device in accordance with claim 11, wherein said fixing base (72) has a lower portion defining a receiving hole (723) for receiving said compression member (74), and said lower portion of each of said two pressing plates (73) defines a receiving chamber (731) for receiving said respective end of said compression member (74).

15. The folding frame device in accordance with claim 11, wherein each of said two pressing plates (73) includes an anti-slip portion (736) formed on the lower potion thereof.

* * * * *